US009041754B2

(12) United States Patent
Inaba

(10) Patent No.: US 9,041,754 B2
(45) Date of Patent: May 26, 2015

(54) DUPLEX PRINTER APPARATUS

(71) Applicant: TOSHIBA TEC KABUSHIKI KAISHA, Shinagawa-ku, Tokyo (JP)

(72) Inventor: Hiroyuki Inaba, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/197,379

(22) Filed: Mar. 5, 2014

(65) Prior Publication Data

US 2014/0253659 A1 Sep. 11, 2014

(30) Foreign Application Priority Data

Mar. 5, 2013 (JP) ..... 2013-042827

(51) Int. Cl.

| | |
|---|---|
| ***B41J 2/00*** | (2006.01) |
| ***B41J 2/355*** | (2006.01) |
| ***B41J 2/32*** | (2006.01) |
| ***B41J 3/54*** | (2006.01) |
| ***B41J 3/60*** | (2006.01) |

(52) U.S. Cl.
CPC *B41J 2/3555* (2013.01); *B41J 2/32* (2013.01); *B41J 3/546* (2013.01); *B41J 3/60* (2013.01)

(58) Field of Classification Search
USPC ..... 347/171, 190–192, 218; 358/1.8, 1.18, 358/502, 503; 399/364, 372, 374; 400/120.01, 120.14, 188
See application file for complete search history.

(56) References Cited

U.S. PATENT DOCUMENTS

| | | | | |
|---|---|---|---|---|
| 6,795,103 | B2 * | 9/2004 | Okayasu et al. | 347/192 |
| 2008/0316534 | A1 * | 12/2008 | McGarry et al. | 358/1.18 |
| 2011/0102485 | A1 * | 5/2011 | VanDemark et al. | 347/8 |

FOREIGN PATENT DOCUMENTS

| | | | | |
|---|---|---|---|---|
| JP | 2003-251595 | | 9/2003 | |
| JP | 2004098503 | A * | 4/2004 | B41J 3/60 |

* cited by examiner

*Primary Examiner* — Kristal Feggins
(74) *Attorney, Agent, or Firm* — Amin, Turocy & Watson, LLP

(57) ABSTRACT

In accordance with one embodiment, a duplex printer apparatus comprises a first printing section configured to use an inkjet mechanism for carrying out printing on a first surface of a paper wound in a roll shape; a second printing section configured to be arranged at the downstream side of the first printing section in a paper conveyance direction and use a thermal printing mechanism for carrying out printing on a second surface serving as the back side of the first surface of the paper; and a heat amount changing section configured to change, according to the difference of printing by the first printing section, a driving condition of the thermal printing mechanism when the second printing section applies heat to a paper.

3 Claims, 4 Drawing Sheets

FIG.3

| TOTAL DOT NUMBER | CHANGING CONDITION |
|---|---|
| LESS THAN A DOTS | NO CHANGE ON BASIC ENERGIZATION TIME |
| MORE THAN A DOTS AND LESS THAN B DOTS | INCREASE BASIC ENERGIZATION TIME BY A FACTOR OF 1.1 |
| MORE THAN B DOTS | INCREASE BASIC ENERGIZATION TIME BY A FACTOR OF 1.2 |

DUPLEX PRINTER APPARATUS

CROSS-REFERENCE TO RELATED APPLICATION

This application is based upon and claims the benefit of priority from Japanese Patent Application No. 2013-042827, filed Mar. 5, 2013, the entire contents of which are incorporated herein by reference.

FIELD

Embodiments described herein relate to a duplex printer apparatus for carrying out printing on a paper and then issuing the paper.

BACKGROUND

In a printer apparatus used as an issuing apparatus issuing a receipt and the like, a long-sized paper pulled out from a paper wound in a roll shape is printed with specific items and cut into a sheet having a specific length and then discharged.

As the printer apparatus, there exists a duplex printer carrying out printing on both the front and the back surface of the paper so as to reduce the usage amount of paper. A printer is known which uses an inkjet printing mechanism as a mechanism printing on one surface of the paper, and uses a thermal printing mechanism as a mechanism printing on the other surface of the paper.

The inkjet printing mechanism jets liquid ink on the paper to carry out printing on the paper. As a result, the paper absorbs moisture from the jetted ink. The moisture absorption amounts differ depending on the category of printing. For example, the ink jetting amount to the paper in a case of printing a photograph is different from that in a case of printing characters, and the larger the ink jetting amount is, the larger the moisture absorption amount of the paper is.

The thermal printing mechanism, as is arranged at the downstream side of the inkjet printing mechanism in the paper conveyance direction, is influenced by the moisture absorption amount of the printing by the inkjet printing mechanism, as a result, there exists a problem that the thermal printing quality on the back surface is reduced due to the influence of the printing category of the inkjet printing mechanism.

BRIEF DESCRIPTION OF THE DRAWINGS

FIG. 3 is a diagram illustrating a data table of a heat amount changing section of the duplex printer apparatus according to the present embodiment.

DETAILED DESCRIPTION

In accordance with one embodiment, a duplex printer apparatus comprises a first printing section configured to use an inkjet mechanism for carrying out printing on a first surface of a paper wound in a roll shape; a second printing section configured to be arranged at the downstream side of the first printing section in the paper conveyance direction and use a thermal printing mechanism for carrying out printing on a second surface serving as the back side of the first surface of the paper; and a heat amount changing section configured to change, according to the difference of printing by the first printing section, a driving condition of the thermal printing mechanism when the second printing section applies heat to a paper.

Hereinafter, the duplex printer apparatus according to the present embodiment is described in detail with reference to accompanying drawings.

Figure 1:
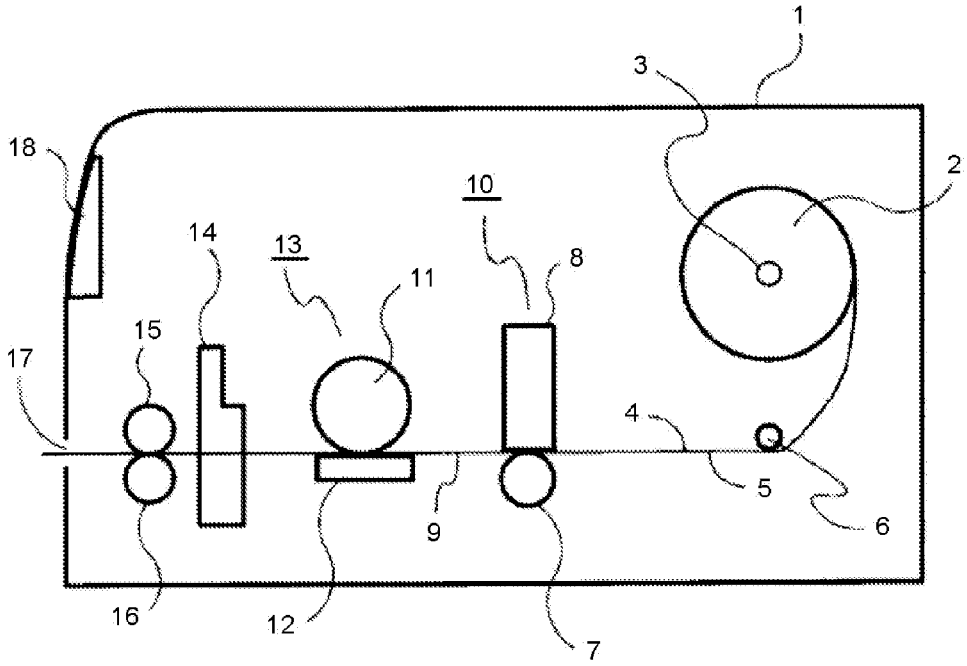
FIG. 1 is a constitution diagram illustrating main portions of a duplex printer apparatus according to one present embodiment.

FIG. 1 is a constitution diagram illustrating main portions of the duplex printer apparatus according to a first embodiment. In addition, as a paper 2 is conveyed from the right side to the left side of the figure in the printer, the right side of the figure is referred to as an upstream side and the left side is referred to as a downstream side in the following description.

Further, there also exists a case where the paper is conveyed in a direction opposite to the conveyance direction in an printing operation so as to align the positions of the leading ends of the cut paper, however, the upstream and downstream in the present embodiment are defined as the upstream and downstream in the conveyance direction of paper when carrying out printing on the paper.

The sign 2 in FIG. 1 represents the paper wound in a roll shape around a winding shaft 3 which is rotatably supported in the printer 1. Further, the paper 2 has a first printing surface 4 and a second printing surface 5 serving as a surface opposite to the first printing surface 4, and a thermosensitive layer which generates color when heated is arranged only on the second printing surface 5.

An idle roller 6 is rotatably supported at the downstream side of the paper 2. At the downstream side of the idle roller 6, a first platen roller 7 which can be rotated by a motor (not shown) and an inkjet head 8 are arranged opposite to each other across a paper conveyance path 9. The first platen roller 7 and the inkjet head 8 constitute a first printing section 10 which carries out printing on the first printing surface 4.

At the downstream side of the first printing section 10, a second platen roller 11 which can be rotated by a motor (not shown) and a thermal print head 12 arranged opposite to each other across the paper conveyance path 9. The second platen roller 11 and the thermal print head 12 constitute a second printing section 13 which carries out printing on the second printing surface 5.

A cutter 14 is arranged at the downstream side of the second printing section 13. The cutter 14 includes a fixed blade and a movable blade none of which is shown in the figure, and the paper 2 inserted into a slit (not shown) arranged in the cutter 14 is cut by sliding the movable blade towards the fixed blade under a driving force of a cutter motor (not shown).

The cutter 14, which is not limited to a slide type cutter sliding the movable blade towards the fixed blade described herein, may also be a rotary type cutter cutting a paper by rotating the movable blade towards the fixed blade.

At the downstream side of the cutter 14, a feed roller 15 which can be rotated by a motor (not shown) and an idle roller 16 are arranged opposite to each other across the paper conveyance path 9. Further, the printer 1 is provided with, at the downstream side of the feed roller 15, a paper discharge port 17 through which the printed paper 2 cut by the cutter 14 is discharged to the outside of the printer 1.

Further, a display section 18 is arranged in the printer 1 to display various states of the printer 1, including an error condition.

Figure 2:
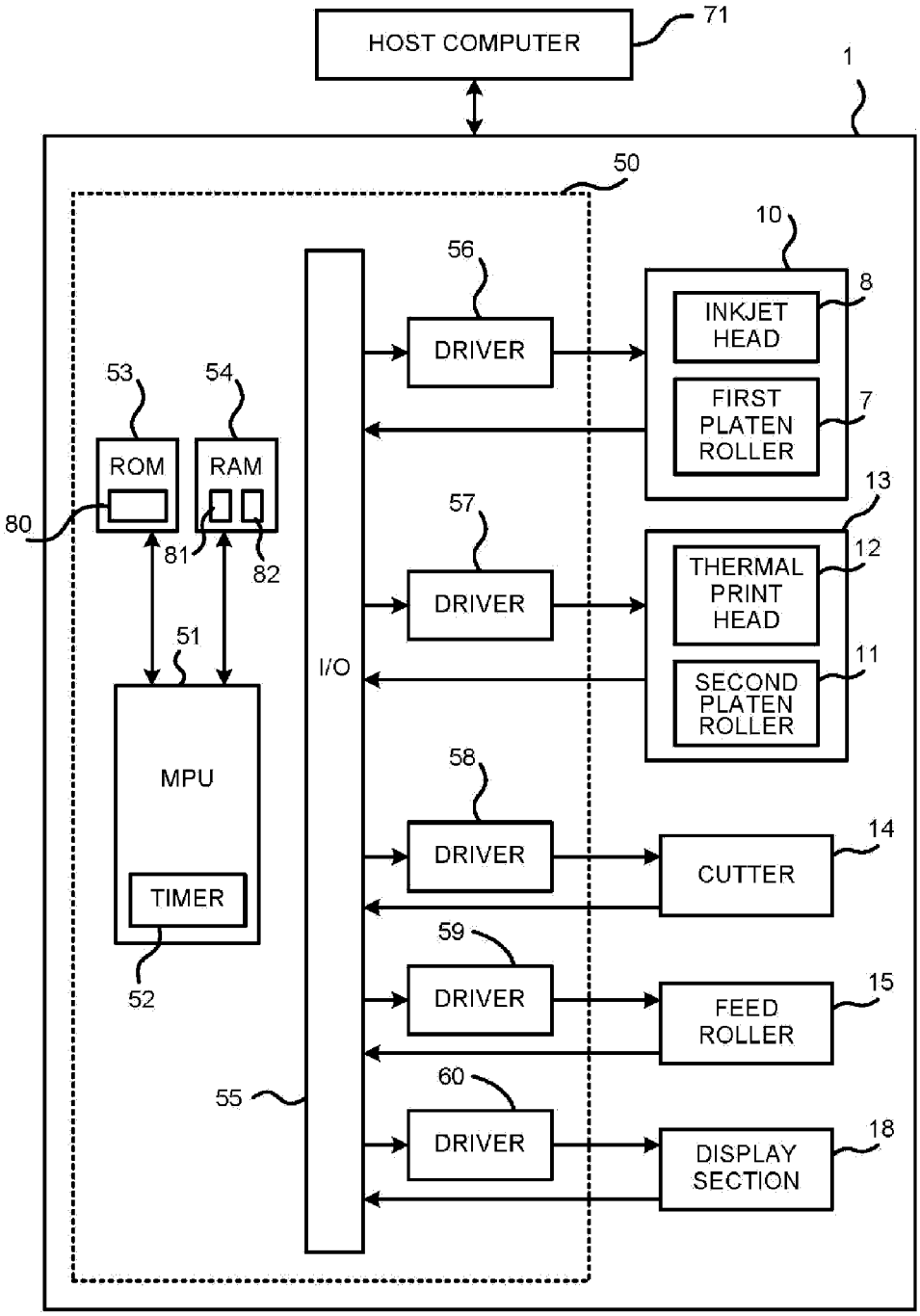
FIG. 2 is a block diagram illustrating a control circuit constitution of the duplex printer apparatus according to the present embodiment.

FIG. 2 is a block diagram illustrating the control circuit constitution of the duplex printer apparatus according to the present embodiment. A control section 50 carries out controls on paper conveyance, printing, paper cutting, paper discharge and printer condition display.

The control section 50 is constituted by, for example, a microcomputer which connects with a host computer 71 and executes various controls, and comprises a MPU 51, a ROM 53 and a RAM 54.

Further, the MPU 51 comprises a timer 52 serving as a unit carrying out time setting and time control.

A ROM 53 and a RAM 54 are arranged in the control section 50 as primary storage units for storing control programs executed by the MPU 51 and data generated during a control process or an operation process.

The ROM 53 is a read-only memory in which control programs and tables and the like are stored, and the RAM 54 is a random access memory for storing the data generated during an operation process.

Further, a data table 80 which will be described later is stored in the ROM 53.

In addition, a first printing surface data storage section 81 and a second printing surface data storage section 82 are arranged in the RAM 54 to divide the printing data from the host computer 71 into the data to be printed on the first printing surface 4 and the data to be printed on the second printing surface 5, and then store the divided data respectively.

Moreover, an input/output unit (I/O) 55 is arranged in the control section 50 to acquire various input data from the host computer 71 and export a control output of the control section 50 to the host computer 51. The I/O 55 is connected with the MPU 51, the ROM 53 and the RAM 54 via a bus line.

Further, the I/O 55 is connected with a first, a second, a third, a fourth and a fifth driver 56, 57, 58, 59 and 60 serving as units for exporting a control output.

The first driver 56 supplies a required drive output for the printing section 10. The second driver 57 supplies a required drive output for second printing section 13. The third driver 58 supplies a drive output for the cutter 14. The fourth driver 59 supplies a drive output for the feed roller 15. The fifth driver 60 supplies a display drive output for the display section 18 to enable the display section 18 to carry out various displays.

The first platen roller 7 is rotationally driven by a motor (not shown) in synchronization with the printing operation based on a control output serving as a printing instruction unit of the MPU 51. The inkjet head 8 carries out printing on the first printing surface 4 of the paper 2 based on the first printing surface data which is created by the MPU 51 based on the printing data from the host computer 71 and is stored in the first printing surface data storage section 81.

The second platen roller 11 is rotationally driven by a motor (not shown) in synchronization with the printing operation based on a control output serving as a printing instruction unit of the MPU 51. The thermal print head 12 carries out printing on the second printing surface 5 of the paper 2 based on the second printing surface data which is created by the MPU 51 based on the printing data from the host computer 71 and is stored in the second printing surface data storage section 82.

Further, the data table 80, one example of which is shown in FIG. 3, of the heat amount changing section is stored in the ROM 53.

For the paper, since the moisture absorption amount of the paper increases as the amount of the printing dots jetted by the inkjet head 8 increases, the printing quality of the printing by the thermal print head 12 which is arranged at the downstream side of the inkjet head 8 in the paper conveyance direction to carry out printing after the printing of the inkjet head 8 will be affected. More specifically, as the moisture of the paper deprives of the heat, for the same energization time of the thermal print head 12, the larger the moisture absorption amount of the paper is, the less the color generation of the thermosensitive layer is.

However, if the number of the printing dots, which will affect the moisture absorption, is counted in advance, and the energization time is made longer accordingly, the quantity of the heat generated by the thermal print head 12 increases, therefore, the color generation reduced due to the heat's being deprived of by the moisture is offset, thereby the printing becomes possible.

Figure 4:
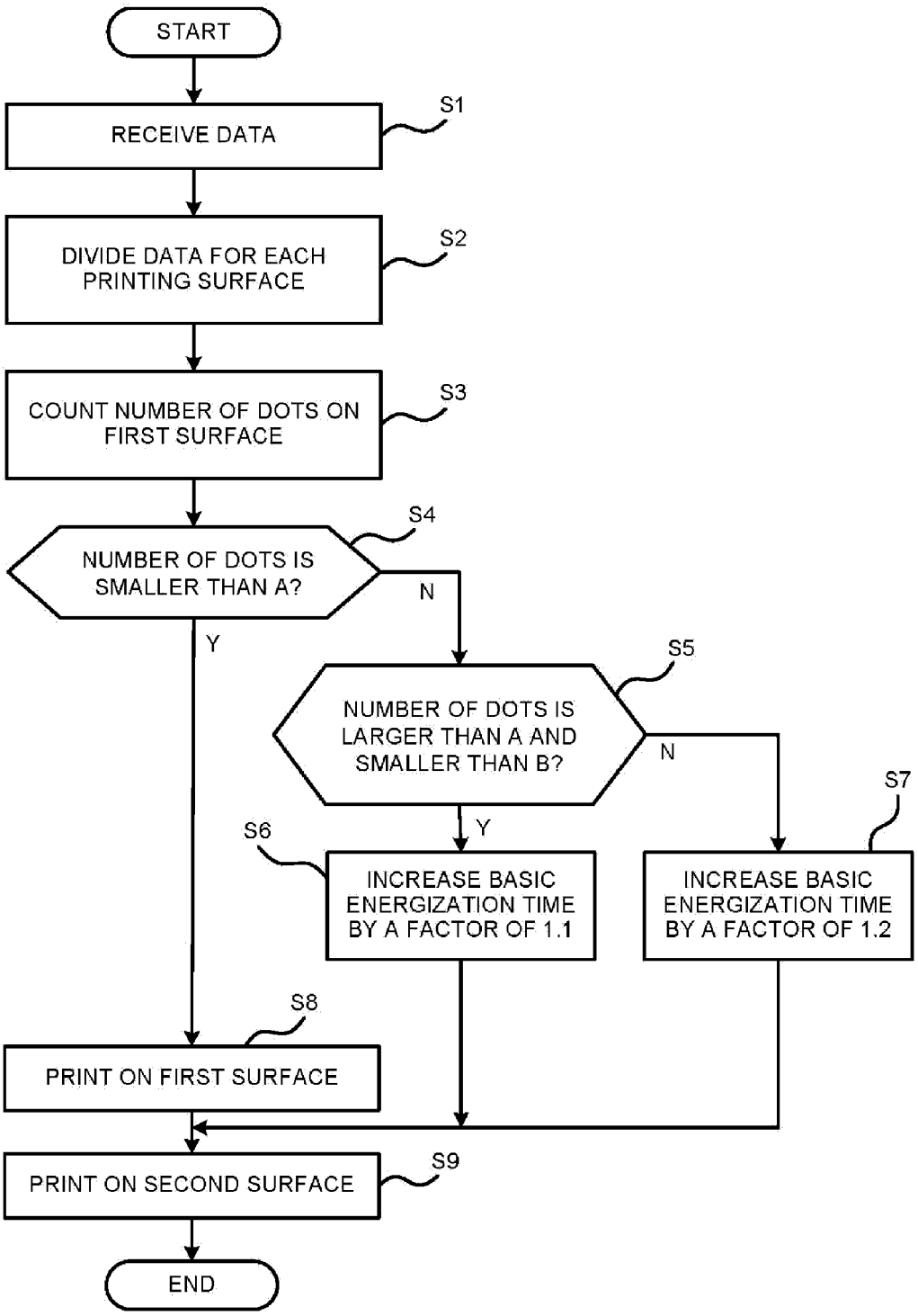
FIG. 4 is a flowchart illustrating a flow of printing of the duplex printer apparatus according to the present embodiment.

Hereinafter, the operations of the printer 1 are described with reference to FIG. 4. The control section 50 carries out the paper conveyance and the printing operation according to the program stored in the ROM 53.

A user first pulls out the paper 2, and then sets the paper 2 in such a manner that the front end thereof passing through the idle roller 6 is positioned between the inkjet head 8 and the first platen roller 7.

If the printing data from the host computer 71 shown in FIG. 2 is received in this state (ACT S1), the control section 50 first divides, using the program (not shown) stored in the ROM 53, the printing data from the host computer 71 into the first printing surface data and the second printing surface data (ACT S2), and then respectively stores the divided data in the first printing surface data storage section 81 and the second printing surface data storage section 82 arranged in the RAM 54. Further, a printing dot counting section (not shown) is arranged in the ROM 53, the first printing surface data is analyzed to count how many dots of ink are to be jetted on the first printing surface 4 (ACT S3)

In addition, a basic energization time is pre-set in the ROM 53 according to the data indicating the relation between the color generation degree of the thermosensitive layer arranged on the second printing surface 5 of the paper 2 and the energization time of driving the thermal print head 12 in a case where the effect of the first printing section 10 is not taken into consideration. If the energization time is not changed, the thermal print head 12 is driven for the basic energization time and the thermosensitive layer of the paper generates color accordingly.

Next, the control section 50 determines, using the heat amount changing section arranged in the ROM 53, how to change the energization time of the thermal print head 12 when carrying out printing on the second printing surface 5 using a calculation value which indicates the number of dots of ink to be jetted on the first printing surface 4 and is being calculated using the program stored in the ROM 53.

First, it is determined whether or not the number of dots on the whole first printing surface is smaller than A (ACT S4). If the number of dots is not smaller than A (NO in ACT S4), it is determined whether or not the number of dots on the whole first printing surface is larger than A and smaller than B (ACT S5). If the number of dots is not in a range from A to B (NO in ACT S5), an instruction is given to set the energization time of the thermal print head 12 when carrying out printing on the second printing surface 5 to be 1.2 times as long as the basic energization time since now.

If the number of dots on the whole first printing surface is larger than A and smaller than B (YES in ACT S5), an instruction is given to set the energization time of the thermal print head 12 when carrying out printing on the second printing surface 5 to be 1.1 times as long as the basic energization time since now.

If the number of dots on the whole first printing surface is smaller than A (YES in ACT S4), no instruction is given to change the basic energization time of the thermal print head 12 when carrying out printing on the second printing surface 5.

Then, the MPU 51 of the control section 50 sends the first printing surface data stored in the first printing surface data storage section 81 to the first printing section 10, and rotates the first platen roller 7 to carry out printing on the first printing surface 4 through a cooperation with the inkjet head 8 (ACT S8).

Then, the MPU 51 of the control section 50 sends, at a time when a paper sensor (not shown) detected that the paper 2 reached a position where the printing can be carried out on the second printing surface 5 of the paper 2 by the second printing section 13, the second printing surface data stored in the second printing surface data storage section 82 to the second printing section 13, and carries out printing using the thermal print head 12 (ACT S9), and as stated above, the energization time of the thermal print head 12 when carrying out the printing is changed according to the number of dots on the first printing surface 4.

When the printing on the first printing surface 4 by the first printing section 10 and the printing on the second printing surface 5 by second printing section 13 are completed, the cutter 14 cuts the paper 2, and then the printed paper 2 is conveyed towards the downstream side through the cooperation of the feed roller 15 and the idle roller 16 and is discharged to the outside of the printer 1 through the paper discharge port 17.

Then the feed roller 15, the second platen roller 11 and the first platen roller 7 are rotated in a direction opposite to the rotation direction when printing to convey the paper 2 to a next printing start position, and then the conveyance is stopped to wait for the reception of a next printing data from the host computer 71.

As described above, in the present embodiment, the printing is protected from the influence of the printing by the first printing section by changing the heat amount applied to the paper from the second printing section according to the difference of printing by the first printing section. In addition, the difference of printing may be the difference of ink jetting amount on a unit area described in the present embodiment, or the difference of an output of a photographic image and an output of data different from the photographic image.

Further, in the present embodiment, the actual energization time is set to be 1.1 or 1.2 times as long as the basic energization time according to the number of dots in the printing, however, it is presented by way of example only, for example, the magnification may also be made higher or lower according to various characteristics of the thermal print head, the category or the property of the used paper.

Moreover, the present embodiment calculates the number of dots on the whole first printing surface and then changes the energization time accordingly, however, it is not limited to this, the energization time may also be changed according to, for example, the number of dots on a smaller area. Further, the range of the number of dots, which is divided into three categories in the present embodiment, is, however, not limited to this, it may also be divided into two or four or more categories.

Further, in the present embodiment, the number of dots on the first printing surface is calculated every time before printing, and then the energization time of the thermal print head 12 is changed accordingly, however, the present invention is not limited to this. For example, in a case where it is determined to print a photographic image on the first printing surface, and the number of dots of the printing object can be known in advance, an operator sets, using a setting section (not shown), how much the basic energization time should be changed, thereby, it is possible to carry out printing without calculating the number of dots on the printing surface every time before printing.

In addition, the amount of heat applied to a paper may also be changed by changing the number of resistors which generate heat at the same time instead of changing the energization time.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A duplex printer apparatus, comprising:

a first printing section configured to use an inkjet mechanism for carrying out printing on a first surface of a paper wound in a roll shape;

a second printing section configured to be arranged at the downstream side of the first printing section in a paper conveyance direction and use a thermal printing mechanism for carrying out printing on a second surface serving as the back side of the first surface of the paper; and a heat amount changing section configured to change, according to number of dots printed by the first printing section on the first printing surface of the paper, an amount of heat generated by the thermal printing mechanism when the second printing section applies the heat to the paper, wherein the heat amount changing section increases the amount of the heat generated by the thermal printing mechanism when the number of dots printed by the first printing section on the first printing surface of the paper increases.

2. The duplex printer apparatus according to claim 1, wherein the heat amount changing section changes a driving condition of the thermal printing mechanism according to a counting value of a printing dot counting section that counts the number of dots on the first printing surface.

3. The duplex printer apparatus according to claim 1, wherein the heat amount changing section changes an energization time of the thermal printing mechanism in the second printing section according to the number of dots printed by the first printing section on the first printing surface.

* * * * *